United States Patent [19]

Bailey et al.

[11] Patent Number: 4,631,817

[45] Date of Patent: Dec. 30, 1986

[54] ONE-PIECE PIN INSERTION TOOL

[75] Inventors: Timothy F. Bailey, Springfield, Mass.; David M. Landry, Windsor, Conn.

[73] Assignee: Combustion Engineering, Inc., Windsor, Conn.

[21] Appl. No.: 708,627

[22] Filed: Mar. 6, 1985

Related U.S. Application Data

[63] Continuation of Ser. No. 412,651, Aug. 30, 1982, abandoned.

[51] Int. Cl.[4] ..... H01R 43/00

[52] U.S. Cl. ..... 29/747; 29/739; 29/845

[58] Field of Search ..... 29/764, 739, 741, 747, 29/758, 845

[56] References Cited

U.S. PATENT DOCUMENTS

| | | | |
|---|---|---|---|
| 2,907,241 | 10/1959 | Lazar | 29/747 X |
| 3,010,193 | 11/1961 | Croall, Jr. et al. | 29/758 X |
| 3,110,093 | 11/1963 | Johnson | 29/747 |
| 3,621,555 | 11/1971 | Cowmeadow | 29/764 X |
| 4,433,476 | 2/1984 | Bailey et al. | 29/747 X |

*Primary Examiner*—Carl E. Hall

*Attorney, Agent, or Firm*—David L. Smith

[57] ABSTRACT

Press element insertion apparatus (10) is a press-like apparatus used to insert pins (28) or sockets (28) into a cable connector (14) where the outside diameter of the insulation on the conductor (30) is less than or equal to the outside diameter of the element (38) shank. One-piece element insertion tool (24) wraps more than 180° around the shank of element (28) and securely holds element (28) with a conductor (30) attached thereto during the insertion of an element (28) into a cable connector (14).

3 Claims, 5 Drawing Figures

ONE-PIECE PIN INSERTION TOOL

This is a continuation of application Ser. No. 412,651, filed Aug. 30, 1982.

BACKGROUND OF THE INVENTION

This invention relates to fabricating cable connectors and in particular to apparatus for inserting an element attached to the end of a conductor in a cable connector during fabrication where the outside diameter of the insulation on the conductor is less than or equal to the outside diameter of the element shank.

Insertion of pins and sockets into cable connectors in the manufacture thereof has heretofore been a manual process using hand tools. The hand tool was either a plier-like or screw driver-like device adapted to hold a pin or socket for manual insertion of the pin or socket into a cable connector. The jaws of the plier-like tool closed around the shank of the pin or socket; the screw driver-like tool was semicircular and wrapped halfway around the shank of the pin or socket. Using either of these hand tools is fatiguing as a force of approximately 222 newtons (50 pounds) is required to insert a pin or socket into the cable connector. These hand tools will accommodate a pin or socket with or without a conductor attached thereto.

A manually operated press in the prior art is available to insert pins or sockets into cable connectors. In using the manually operated press, the operator places a pin or socket element into the desired location in the cable connector then inserts the cable connector and element being inserted between the jaws of the press and operates the press to insert the element. The prior art press will only accommodate pins or sockets without conductors attached because the press applied pressure to the pin or socket at the end precisely where the conductor would emerge from the element.

An alternate press available in the prior art has spring loaded jaws that separate to permit the insertion of an element with a conductor attached. The jaws then close around the shank of the element and after insertion of the element the jaws are opened to release the element. Both prior art presses reduce fatigue by providing a mechanical advantage to the operator thereby reducing the force required to insert a pin or socket into a cable connector.

A need exists for a press to insert pins or sockets into cable connectors with conductors attached to the pins or sockets for applications where the outside diameter of the insulation on the conductor is less than or equal to the outside diameter of the element shank. Such a press would have the advantage of being able to insert an element with a conductor attached thereto and the ability to provide a mechanical advantage while simultaneously obviating the need to operate jaws to hold the element during the insertion process. Such a press would be a part of an efficient cable connector manufacturing operation and would reduce the fatigue experienced when inserting pins or sockets into cable connectors and thereby reduce the time required to manufacture cable connectors.

SUMMARY OF THE INVENTION

The present invention fulfills the need of an apparatus for inserting a pin or socket with a conductor attached thereto into a cable connector during cable connector fabrication obviating the need to operate jaws where the outside diameter of the insulation on the conductor is less than or equal to the outside diameter of the element shank. The one-piece press element insertion apparatus of the present invention comprises a one-piece element insertion tool adapted to securly hold a pin or socket with a conductor attached thereto during the insertion process. The element holder is constrained to move perpendicular to the cable connector through a limited distance so that the depth of insertion of the pin or socket in the cable connector can be limited.

DESCRIPTION OF THE PREFERRED EMBODIMENT

Figure 1:
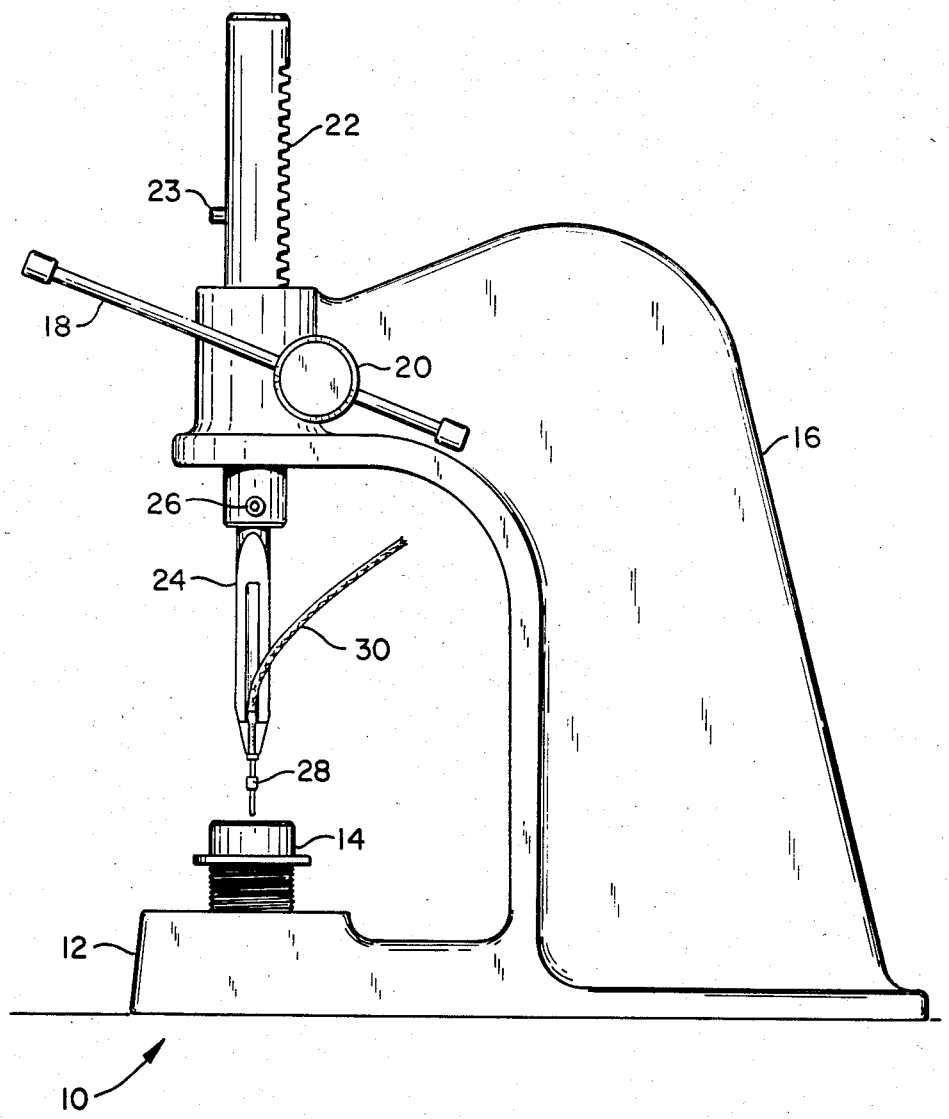
FIG. 1 is a side view of an element insertion apparatus embodying the present invention.

Referring to the drawing, there is depicted therein a press element insertion apparatus 10 in accordance with the present invention as best seen in FIG. 1. Base 12 supports both cable connector 14 and the body 16 of the press 10. Lever 18 pivots pinion 20 which is engaged with rack 22 to operate the press. Rack 22 is constrained to move perpendicular to the top surface of cable connector 14 through a distance limited by stop 23 to limit the depth of insertion of an element in cable connector 14. One-piece element insertion tool 24 is mounted in the lower end of rack 22 and retained in its desired position by lock screw 26. One-piece element insertion tool 24 is designed to securely hold a pin or socket, element 28, with a conductor 30 attached thereto where the outside diameter of the insulation on the conductor is less than or equal to the outside diameter of the shank element 28. With rack 22 in the uppermost position, there must be clearance between one-piece element insertion tool 24 and cable connector 14 to permit an element 28 with a conductor 30 attached thereto to be inserted into one-piece element insertion tool 24. Generally, for the outside diameter of the insulation on a conductor to be less than or equal to the outside diameter of the shank of a pin 28 or socket 28 limits the use of one-piece element insertion tool 24 to 16 gauge wire and smaller wire.

Figure 2:
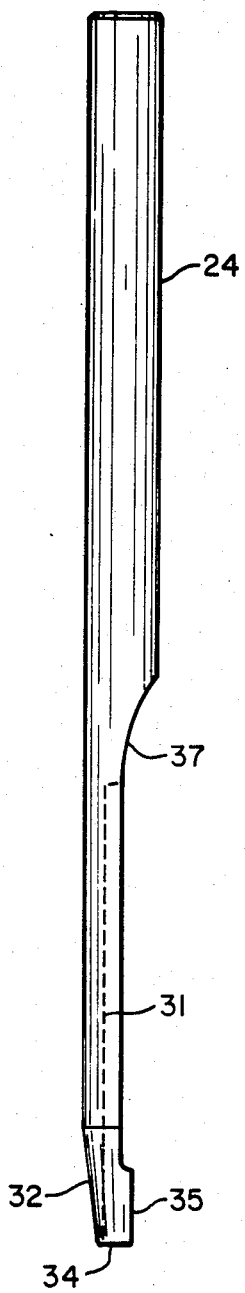
FIG. 2 is a front view of the one-piece element insertion tool.
Figure 3:
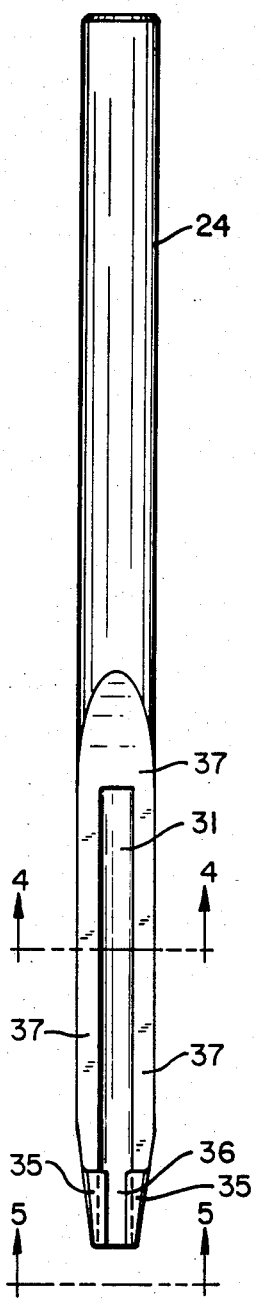
FIG. 3 is a side view of the one-piece element insertion tool.
Figure 5:
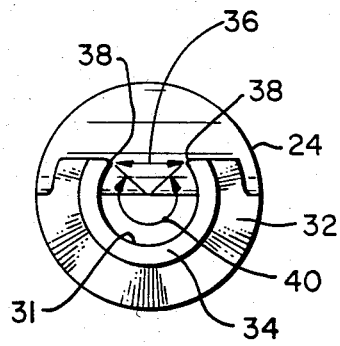
FIG. 5 is an enlarged end view of the one-piece element insertion tool taken along the line 5—5 of FIG. 3.

Referring to FIG. 2, it can be seen that one-piece element insertion tool 24 is made from a rod approximately three times the diameter of the shank of element 28 to be inserted. A bore 31 is drilled axially in one end of the rod to a depth of several times the length of the shank of element 28. The diameter of bore 31 is the diameter of the shank of element 28 plus a tolerance to allow variations in shank size. The drilled end of the rod is then tapered with the diameter of the tapered end being greater than the diameter of bore 31 resulting in a flat somewhat annular surface 34 as best seen in FIG. 5 at the end of the tapered rod. Taper 32 accommodates working in the limited area of a partially completed cable connector 14. Flat surface 34 butts against the insertion shoulder of element 28.

Figure 4:
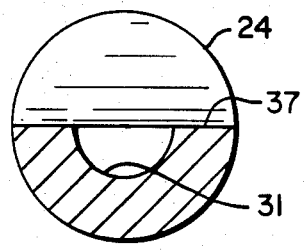
FIG. 4 is an enlarged cross-section of the one-piece element insertion tool taken along line 4—4 of FIG. 3.

The tapered end 32 of the rod is then ground down to a cord less than the diameter of the rod resulting in a flat surface 35 containing slot 36 through which the conductor 30 and insulation pass. Corners 38 are slightly rounded so as not to damage the insulation as it passes through slot 36. Angle 40 remains larger than 180 degrees and thereby prevents an element 28 from being removed laterally once it is inserted in bore 31 because one-piece element insertion tool 24 wraps more than 180° around the shank of element 28. From a point approximately the length of the shank element 28 in from flat surface 34 of the rod, through a length sufficient to accommodate the conductor 30, the rod is ground down to a diameter line forming surface 37 and tapered as shown in FIGS. 2 and 4..

In using one-piece press element insertion tool 10, a cable connector 14 is placed on base 12, an element 28 with a conductor 30 attached thereto is inserted into bore 31 through the tapered end 32 of one-piece element insertion tool 24, conductor 30 and the insulation surrounding conductor 30 passing through slot 36 until flat surface 34 of one-piece element insertion tool 24 butts against the shoulder of element 28 as shown in FIG. 1. Lever 18 is then activated to press the element 28 into cable connector 14 to a depth limited by stop 23 when stop 23 strikes body 16 of press 10. Returning lever 18 to its original position withdraws one-piece element insertion tool 24 with element 28 remaining in cable connector 14 and conductor 30 and the insulation surrounding conductor 30 passing out through slot 36. Another element 28 with a conductor 30 attached thereto is then inserted in one-piece element insertion tool 24, cable connector 14 is repositioned and the insertion process repeated. Alternatively, cable connector 14 could be supported by a cable connector support mounted on the base, such as disclosed in application Ser. No. 364,347, filed Apr. 1, 1982, which prevents cable connector 14 from rotating during fabrication while affording the two degrees of freedom required to reposition cable connector 14 during the insertion of pins and sockets.

One-piece element insertion press 10 has been described with reference to a rack and pinion type press. It is within the scope of the invention that one skilled in the art could apply the invention to any press that constrained the motion of one-piece element insertion tool 24 perpendicular to the top surface of cable connector 14 and further controlled the depth of insertion of element 28 in cable connector 14.

We claim:

1. In fabricating a cable connector, a press for inserting an element attached to the end of a conductor into a cable connector where the outside diameter of the insulation on the conductor is less than or equal to the outside diameter of the element shank, comprising:

(a) a base for supporting the cable connector;

(b) means wrapping more than 180° around an element for holding an element attached to the end of a conductor thereby preventing lateral removal of the element, the holding means having:

i. a bore substantially the diameter of the shank of the element to be inserted, to receive the shank of the element;

ii. a substantially annular surface perpendicular to and surrounding the bore for butting against the shoulder of the element shank during insertion; and iii. a slot to accommodate the conductor and insulation, smaller in width than the outside diameter of the shank of the element being inserted, the slot beginning at the substantially annular surface and extending along the bore at least the length of the shank;

(c) means for supporting the holding means from the base; and (d) means slidably engaged with the support means for restraining the motion of the holding means substantially perpendicular to the base.

2. An apparatus as in claim 1 wherein the restraining means further comprises means for limiting the distance of travel of the slidably engaged means.

3. An apparatus as recited in claim 1 or 2 wherein the slidably engaged means is comprised of:

(a) a rack (b) a pinion engaged with the rack; and (c) a lever engaged with the pinion for rotating the pinion.

* * * * *